United States Patent [19]

Henning et al.

[11] Patent Number: 4,474,154

[45] Date of Patent: Oct. 2, 1984

[54] IDLING SPEED CONTROL FOR INTERNAL COMBUSTION ENGINES

[75] Inventors: Manfred Henning, Kaarst; Wolfgang Misch, Wiehl, both of Fed. Rep. of Germany

[73] Assignees: Robert Bosch GmbH, Stuttgart; Pierburg GmbH & Co KG, Neuss, both of Fed. Rep. of Germany

[21] Appl. No.: 435,642

[22] Filed: Oct. 21, 1982

[30] Foreign Application Priority Data

Oct. 26, 1981 [DE] Fed. Rep. of Germany ..... 3142409

[51] Int. Cl.[3] ..... F02M 3/00

[52] U.S. Cl. ..... 123/339; 123/352; 123/360; 123/362

[58] Field of Search ..... 123/339, 340, 352, 353, 123/360, 362

[56] References Cited

U.S. PATENT DOCUMENTS

| | | | |
|---|---|---|---|
| 3,575,256 | 4/1971 | Jania et al. | 123/340 |
| 3,964,457 | 6/1976 | Coscia | 123/339 |
| 4,098,242 | 7/1978 | Anderson | 123/352 |
| 4,365,601 | 12/1982 | Yamazoe et al. | 123/340 |
| 4,370,960 | 2/1983 | Otsuka | 123/339 |
| 4,401,075 | 8/1983 | O'Keefe, Jr. et al. | 123/339 |

*Primary Examiner*—Andrew M. Dolinar

*Attorney, Agent, or Firm*—Frishauf, Holtz, Goodman, & Woodward

[57] ABSTRACT

Regulation of idling speed involves the production of a first error signal by comparing engine speed with a reference idling speed, and then deriving from the first error signal in an amplifying PI controller, proportional and integral components that are added together, for use of the PI sum signal as a reference value signal for the displaceable stop position. The latter is compared to the actual stop position to provide a second error signal for control of electro-pneumatic valves of a positioning device that displaces the stop. Both the proportional and integral components produced in the controller vary assymetrically about the reference idling speed, so that regulation operates more strongly when the engine speed is too low than when it is too high, except for a dead zone on either side of the reference idling speed. When the driver actuates the throttle, a switch signal designates that the idling condition is no longer present and a lower engine speed threshold defines a starting mode of operation at lower speeds and a higher engine speed threshold distinguishes the "drive" mode from the partial load mode. Suitable operations of the displaceable stop during mode transitions and during operations in non-idling modes are provided. The controller output at the end of the last idling interval is stored for use when the engine returns to the idling mode.

27 Claims, 12 Drawing Figures

IDLING SPEED CONTROL FOR INTERNAL COMBUSTION ENGINES

This invention concerns methods and apparatus for control of the idling speed of the engine of a motor vehicle, including regulation of engine speed in the idling mode of the engine and some other actions in other operation modes of the engine for improved transition into the idling speed mode.

Known devices for vehicle engine idling speed regulation are described, for example, in German published patent applications (OS) Nos. 2 049 669 and 2 546 076. In the first-mentioned of these disclosures a speed-responsive electric circuit acts on an electromagnetically actuatable positioning member which controls the cross-section of a bypass channel parallel for the throttle. In this known device control exclusively of the intake air quantity could be problematic, since in this manner it is evidently not possible to take into comprehensive account all the significant magnitudes influencing engine behavior. In particular, it is not possible to influence actively the position of the throttle and thus to produce an effective change of the fuel-air mixture intake.

The system described in DE-OS No. 2 546 076 for idling speed control operates on a throttle disposed in the intake pipe of the engine. A reference value transducer and an actual value transducer for engine speed values are provided and their outputs are supplied to the two inputs of a differential amplifier. An output error signal is supplied to a positioning member operated as a solonoid. The positioning member is continuously connected to the throttle and shifts the throttle in accordance with the error signal. This circuit, like the one previously mentioned, is not capable of introducing boundary conditions into the regulation process and thereby assuring under all conditions that the idling speed of an internal combustion engine remains within a prescribed region even when rapidly acting transition conditions must be dealt with. In particular the known circuits are not suitable for bringing into play and also for influencing drive operation, for example, for fuel-saving drive limiting.

THE INVENTION

It is an object of the present invention to provide a comprehensive idling speed control for a vehicle engine of the internal combustion type which can take account of previous operation of the engine at the beginning of idling and also of external factors influencing engine behavior.

Briefly, a first error signal is produced by comparison of actual engine speed value with a reference speed value. This first error signal is supplied to a proportional-integral controller (PI controller) in which a proportional component and an integrator condition derived from the first error signal are continually added together to provide a reference value of positioning member position for comparison with the actual position of the positioning member to produce a second error signal by which the engine throttle is controlled in the idling mode by means of a displaceable stop for the throttle valve control, against which the throttle valve control is pressed when the engine is idling (i.e. when the accelerator pedal is unactuated).

Particularly when digital electronic circuits are used for control, the aforesaid proportional and integral components derived from the first error signal are "quantized" to provide variation of these magnitudes stepwise on either side of the reference idling speed, with values being constant over engine speed ranges constituting the various steps, and being null for a dead zone speed range on either side of the reference idling speed. Amplification in the derivation of the proportional and integral components is provided in such a way as to make the value steps steeper for engine speeds above the reference idling speed than for engine speeds below it and the steps for the integral factor are in general different from those for the proportional factor, particularly having greater asymmetry about the reference idling speed.

In modes other than idling, the displaceable stop that controls the idling speed is controlled without reference to engine speed in various ways described further below in the detailed description of the invention, for improving engine behavior in mode transitions, particularly in setting boundary conditions for the onset of the idling mode.

The advantages of the invention, in addition to making possible the provision of suitable boundary conditions for idling speed control, are that disturbing influences can be rapidly sensed and taken account of and the idling speed can be much more precisely set, particularly with regard to the effect of long term influences such as temperature and atmospheric pressure.

The smooth operation of the frequently occuring transitions in the operation of a vehicle engine, for example, from drive to partial load, from partial load to idling, from idling into drive, etc. is a particular advantage of the invention.

The invention provides fully regulated operation with reference to the setting of the idling speed. When the driver races the idling speed, or the engine speed in the near-idling region, a switchover can be produced to drive mode with partial following of the throttle positioning member by the automatic control system.

Regulation and control according to the invention react quickly and reliably to all disturbing magnitudes likely to come into play.

The invention lends itself advantageously to implementation of its overall concept by circuits and systems operating on electronic analog and/or digital bases so that particular partial functions can also be taken over by utilization of computers, especially the now well-known microprocessors.

THE DRAWING

The invention is further described by way of illustrative example with reference to the annexed drawings, in which:

FIGS. 1*a* and 1*b* are graphs of the stepwise control characteristics provided by the proportional and integral components derived from the first error signal, in each case plotted against speed deviation from the reference idling speed;

FIG. 2 for a positioning member during the transition from the drive mode to the idling mode of operation of a vehicle engine;

Figure 7:
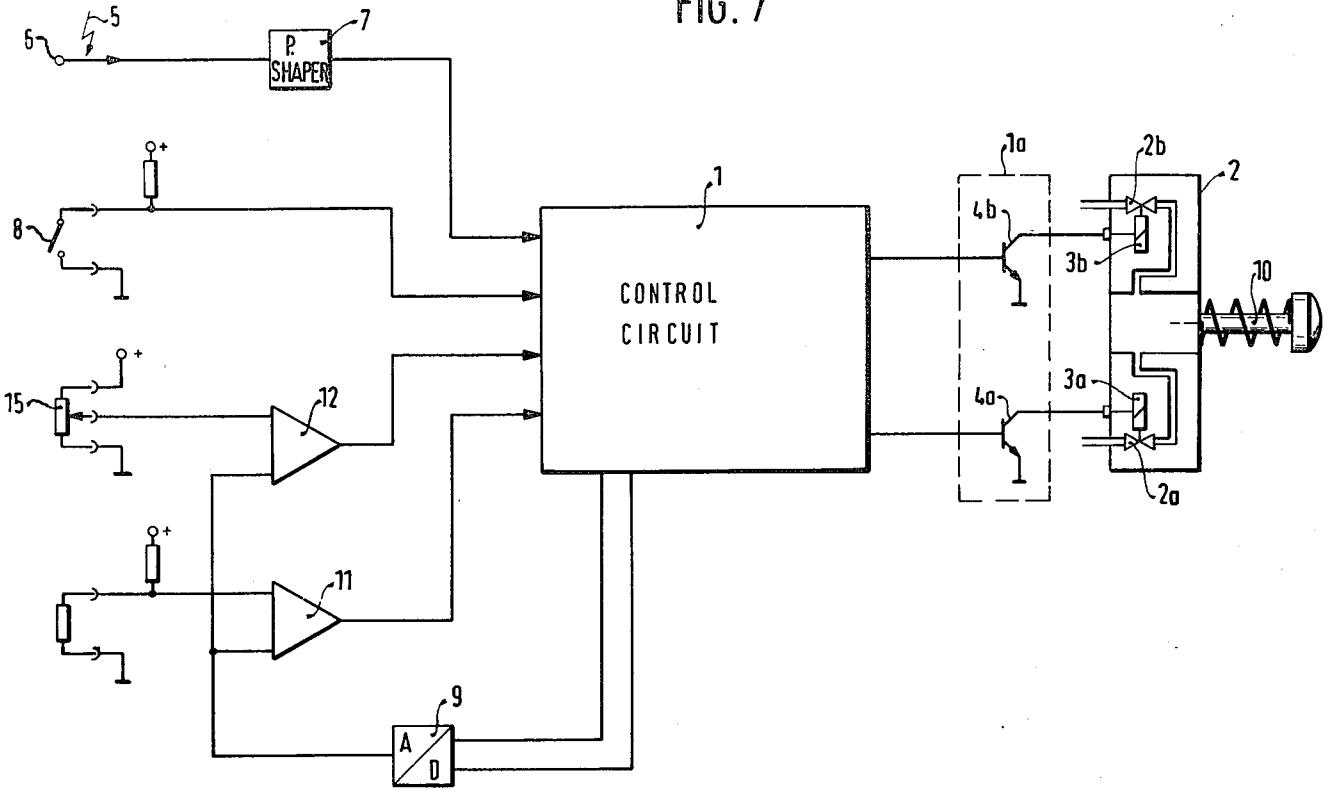
Figure 8:
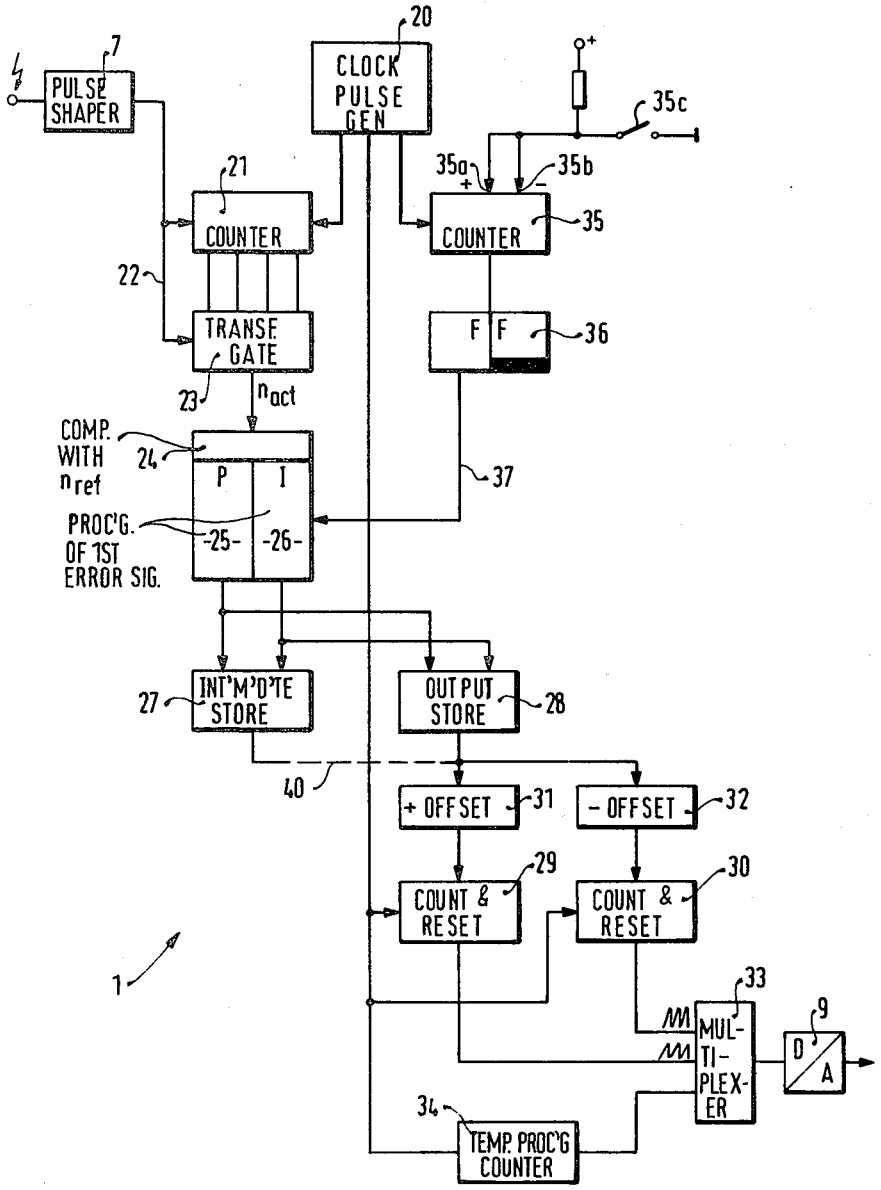

FIGS. 6*a*, 6*b*, 6*c* and 6*d* are wave form diagrams having common time base for explaining the control of valves for actuating a positioning member in a manner similar to pulse length modulation;

FIG. 7 is a circuit block diagram illustrating the inputs and outputs of the control circuit of a system according to the invention, and FIG. 8 is a circuit block diagram of an illustrated form of the control circuit 1 of FIG. 7, utilizing essentially digital techniques.

DESCRIPTION OF THE ILLUSTRATED EMBODIMENTS

For better understanding of the present invention there will be first explained the basic method concept regarding the course of speed regulation and control behavior of a system according to the invention, by reference to the diagrams of FIGS. 1*a*–6*d*, by which the essential functions of the central electronic control circuit 1 of FIGS. 7 and 8 may be kept in mind and explained, with reference to operation in connection with peripheral sensors and circuits that serve mainly for obtaining signals of engine operating parameters. Briefly, as shown in FIG. 7, the central electronic control circuit 1 acts at its output through a final stage 1*a* to operate a positioning device 2 which preferably, as illustrated in FIG. 7, is constituted as an electroneumatic device and makes use of an evacuation valve 2*a* and an air-admitting valve 2*b*. The control of the valves 2*a* and 2*b* takes place electrically over the respective relays 3*a* and 3*b* and as further described below the electric operation involves a method similar to pulse length modulation for the application of electrical signals to the relays respectively connected to the final stage transistors 4*a* and 4*b*. The positioning device 2, by means of its valves 2*a* and 2*b* actuates a displaceable stop 10 against which the main throttle mechanism (not shown) of the engine lies when the engine accelerator is not actuated, so that control of the evacuation valve, the stop 10 is withdrawn and the throttle more strongly closed, while operation of the air-admitting valve presses the stop 10 more strongly (upwards in the drawing) with the result that the throttle is more considerably opened. The main throttle or a mechanical part connected to it, for example a throttle lever, can nevertheless be lifted off the stop 10 by actuation of the accelerator pedal, and accordingly in idling operation it lies merely under spring pressure, for instance, against the displaceable stop 10.

The over idling speed control concept of the present invention distinguishes four operating regions which may be referred to as modes of engine operation which are defined by speed values thresholds and a single extraneous electrical signal derived from the presence of the throttle control mechanism against the displaceable stop 10. The electropneumatic positioning device 2 is controlled by the central electronics regulation and control circuit differently according to which operating mode of the engine is recognized. The four operating modes of the engine to be distinguished for purposes of the invention are characterized and defined as follows:

1. Start-up of the engine recognition: the engine speed is less than a predetermined start speed ($n \leqq n_{St}$)
2. Idling Recognition: the speed lies between the start speed and a drive speed ($n_{St} < n < nTr$) and the throttle mechanism lies against the displaceable stop 10.
3. Partial load operation Recognition: the speed is between the start speed and the drive speed ($n_{St}$ n nTr) and the throttle mechanism does not lie against the displaceable stop 10 (or against any fixed mechanical stop).
4. Drive operation of the engine: the effective actual speed of the engine is greater than or equal to the drive speed boundary (n $n_{Tr}$).

For obtaining and providing a speed signal to the control circuit 1 the most practical method is to measure the time lapse between two successive spark pulses 5 which are made available at the terminal 6 of the circuit of FIG. 1. Of course instead of the spark pulses other signals that are synchronous with motor speed or some constant faction thereof can be used, for example a signal from a transducer that marks the upper dead point of the piston in a particular cylinder of the engine.

For measuring the time lapse between successive pulses that are synchronous with the engine shaft evolution a timing oscillator, commonly referred to as a "clock" circuit, that can be used in the control circuit 1 (not specifically shown in FIG. 7). If in the central control circuit, at least in some modes of operation a so-called microcomputer circuit, preferably a 4-bit microcomputer, is involved, which does not include either a timer or an interrupt possibility, the circuit running of the speed regulator (i.e. the regulator program in such a case) is organized in a loop or cycle. This program element cycle has a constant run time $T_{cy}$ and provides the time base of the control program.

For recognition of a spark pulse, each spark pulse always first sets a flip-flop 7 which operates as an intermediate store. The flip-flop 7 can be either a monostable (monoflop) or a bistable (2 flip-flop) multivibrator. The time lapse between two spark pulses used to measure speed is measured with an oscillator or clock pulse generator of the central control circuit operating at a constant oscillation period and at a frequency which is substantially higher than the higher spark pulse frequency for the speed range of the engine, serving to continually advance the content of a counter, the content of which is transferred to a buffer store every time a spark pulse appears, at which time the counter is also reset. The appearance of a spark pulse can be recognized every time by the switching over of the flip-flop 7 into its other state. The flip-flop 7, if it is a bistable circuit, will either be reset by the next clock pulse, whereby at the same time the transfer of the current count state is put into the buffer store, or if the flip-flop 7 is a monoflop, the resetting is produced automatically by the monoflop when it returns to its normal state. The buffer store content in either case becomes a measure for the time lapse between pulses and hence for the speed of the engine, the resolution of the measurement being determined by the frequency of the clock pulse generator or of the oscillator in the control circuit. If the program cycle frequency of a microcomputer utilized in the system is also used for the derivation of the clock frequency, the intermediate store 7, constituted as a monoflop or as a normal flip-flop is interrogated once per cycle and then either reset by the program (in the case of two stable states of the intermediate store) or automatically reset (in the case of a monoflop). If a monoflop is used, then after the appearance of a spark pulse the program can await the resetting of the monoflop in a short waiting cycle, as the result of which a jitter-free speed measurement is obtained. In this case T mono $T_{cy}$. Also in this case the counter is raised by the running of every cycle, so that when the next spark pulse appears a count content corresponding to the interpulse interval of spark pulses (inversely proportional to speed) is present in the counter and can be loaded into the buffer store. In this store there is accordingly always an actual engine speed signal which can be evaluated and made available in the control circuit 1.

The determination whether the throttle mechanism is lying agains the displaceable stop 10 or not, indicating whether the throttle is closed so far as possible or is in a more open position, is performed by means of the throttle mechanism switch 8 shown in FIG. 7 in order to distinguish between certain of the operating modes of the engine set forth above. The throttle mechanism switch 8 can for example be constituted so that when the throttle mechanism is lying against the displaceable stop 10, a logic 1 signal is produced and when it is lifted off the stop 10, a logic 0 signal is produced. It is possible to evaluate these signal conditions directly by the control circuit 1. For eliminating the disturbance of switch contact bounce, for after all, this is a matter of a mechanical switch, it is advantageous to cause the logic 1 signal from the switch 8 to produce advance of a counter by the oscillator or other source of clock pulses in the control circuit 1, or by means of the program cycle of a microprocessor, while during logic signal 0 the same counting pulses are used to lower the count content in that counter. This last-mentioned counter can thus be ready at all times to count up or down between its maximum and minimum values. When one of its count boudaries is reached, an intermediate store is set or reset. In this manner, the intermediate store can, for example, produce logic signal 1 when the maximum count value is reached, and logic signal 0 when minimum count value is reached. It will be recognized that this intermediate store would most suitably be a bistable circuit and its output signals can reliably be utilized to indicate whether the throttle is or is not lying against a stop.

As already mentioned, the provision of actual engine speed value and of a signal that shows whether or not the throttle is lying against a stop, gives the control circuit 1 all the necessary information of distinguishing between the four modes of operation of the engine described above. Certain reference values of speed will need to be prescribed for (stored in) the control circuit for performance of its functions, and these can be provided either as a count value for use in digital circuits or a constant voltage for use in analog circuits, since the comparison of speed values can be carried out either with digital or analog comparators. One of the stored speed values will of course be the reference idling speed value representing the normally desired idling speed.

The central control circuit 1 is so designed that it contains at least one controller-type amplifier that is so constituted that it has a PI controller characteristic. This PI controller characteristic serves for the idling mode of engine operation and is defined for the overall behavior of the particular control means provided for the displaceable stop 10, including the final stage 1*a* and the positioning mechanism 2. The PI controller characteristic can operate with continuous varying (i.e., unstepped) proportional components and continuously varying integrator running speeds, particularly when the control circuit is constituted in analog fashion, but here also a certain assymetry in the PI controller characteristic is preferably provided, by which, for instance, when the idling speed falls below the desired idling speed the reaction can be faster and stronger, perhaps with a contribution of a differential component, in order to "rescue" the engine from a possible stall.

Figure 1A:
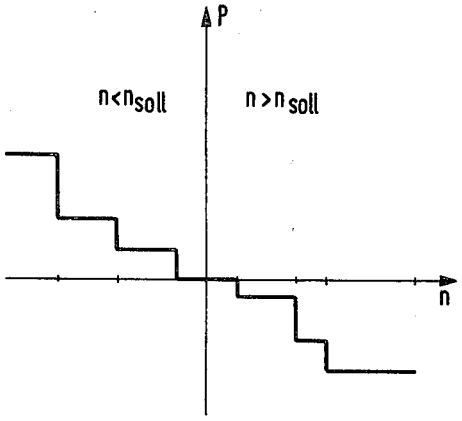
Figure 1B:
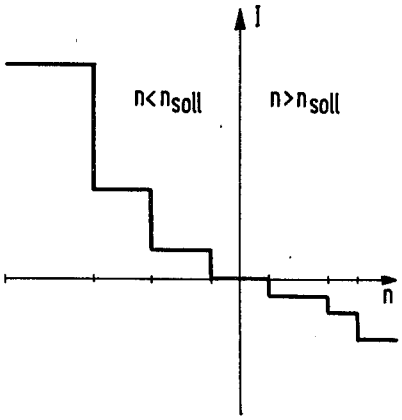

If the control circuit 1 is constituted with digital components or built around a microcomputer, then, for simplification of the program structure, the controller stage will generally not operate with continuously varying proportional components and integrator running speeds, but instead the overall speed range will be subdivided into a number of ranges corresponding to the graphical representations of FIGS. 1*a* and 1*b*. Preferably regions of different size about the reference idling speed are defined, and each speed range can have for that range a constant proportional component and a constant integration running speed. In this fashion, stepped platform curves are provided for various extents of regulation deviation, both for the P and for the I component.

It can be seen from FIGS. 1*a* and 1*b* that, apart from a null region (dead zone), symmetrically disposed on both sides of the reference idling speed, different magnitudes of proportional components and integrator running speeds for upwards and downwards deviation from the reference idling speed, so that overall a nonlinear control characteristic results with any desired strength of attack and reaction when particular engine speed regions disposed on one side or the other of the reference idling speed are reached by the actual engine speed.

The proportional component and the content of the integrator of the controller stage are added together and utilized for controlling the positioning device. In the case of digital constitution of the control circuit the PI sum can be put into an output store and into an intermediate store. Possible variants include the formation in an intermediate store of a value averaged over a certain time and its transfer into an output store. So long as the engine is operating in the idling mode, the circuit operates according to a concept of completely regulated operation in which, as further explained below, the actual position of the displaceable stop 10 produced by the positioning device 2 is picked up and compared with a reference position value which is represented by the PI sum at the output of the controller-amplifier.

When the engine goes from idling into the partial load mode of operation, wherein the throttle mechanism is actuated by the accelerator pedal and no longer lies against the displaceable stop 10 and the throttle switch provides an "accelerator actuation" signal, going from logic 0 to logic 1, that signal holds the integrator in an existing state and causes a suitable blocking signal to prevent further evaluation of the P component derived from the idling speed error signal. The PI sum then present in the intermediate store, which corresponds to the last value of that sum while the engine was operating in the idling mode, continues to be used for controlling the positioning device 2, so that the latter at first holds steady in its last position before the accelerator moves the throttle. If the operation then changes to a "drive" mode, defined by the speed exceeding the drive threshold speed, the control circuit 1 recognizes the overstepping of that speed threshold and causes the positioning device 2 to retract the stop 10. Similarly, if in the drive mode the accelerator pedal is released, the throttle switch can be used to provide a fuel consumption reduction by corresponding control of the fuel-air mixing device, whatever it may be, for example a carburetor.

In the start-up mode of the engine, the engine speed is less than a threshold running speed $n_{St}$ at which the system recognizes that the engine has started. During the start-up mode, i.e., before $n_{St}$ is reached, the control circuit 1, upon recognizing the start-up mode, causes the displaceable stop to be advanced to its highest engine speed position in order to provide a standardized initial condition. In a preferred embodiment of the system and method of the invention, a temperature measurement is made as soon as possible to set the initial values for the integrator content and for the PI sum in the intermediate store and output store of the controller amplifier.

In transitions between operating modes of the engine, there are accordingly the following special functions now to be further described with reference to FIGS. 2–4. Each of the transitions can readily be sensed and managed by the control circuit 1 by modification of the speed signal and the throttle switch signal.

Figure 2:
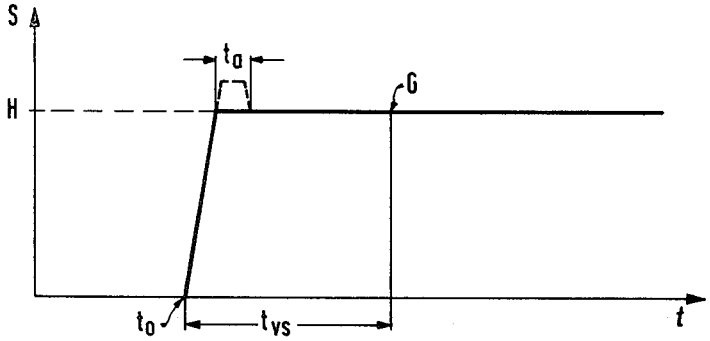

If there is a transition from drive into idling, as shown in FIG. 2, for a certain time $t_{vs}$ (which can be 2 seconds, for example), the PI sum in the intermediate store is provided for the control of the displaceable stop 10 (compare the progress of the displacement S with respect to time t illustrated in FIG. 2). The displaceable stop therefore takes the last position it had in idling operation before transition into another mode. There is the further possibility, however, which can also be brought in to some advantage, to add for a short time $t_a$ (e.g., $t_a=0.2$ s), to the output value from the intermediate store, a constant, as shown in broken lines in FIG. 2 for that time interval. This produces a brief intake increase immediately after a drive cut-off in order to avoid unduly sudden drop-off of engine speed. After the lapse of the interval $t_{vs}$ (including $t_a$), the idling speed regulation is allowed to go into effect again.

Figure 3:
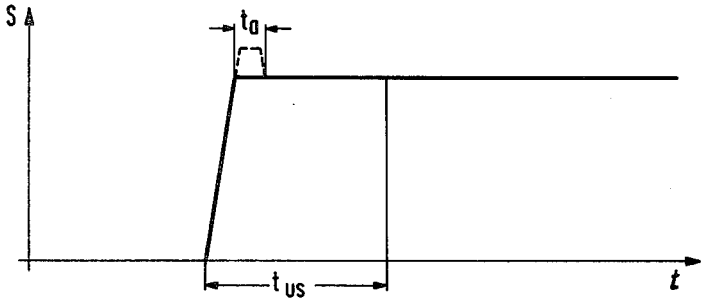
FIG. 3 is a diagram similar to FIG. 2 for the transition from drive to partial load.

If there is a transition from drive into partial load, operation can proceed corresponding to the diagram of FIG. 3 in the same manner as before the transition from drive to idling shown in FIG. 2. After the transition interval $t_{vs}$, however, idling speed regulation is not put into operation, and, on the contrary, the displaceable stop 10 sticks in the position it had at the end of the last idling period, corresponding to the PI sum stored in the intermediate store. The transition interval $t_{vs}$ drawn in FIG. 3 is accordingly provided merely for better understanding and is of no actual significance for this particular transition operation.

Figure 4:
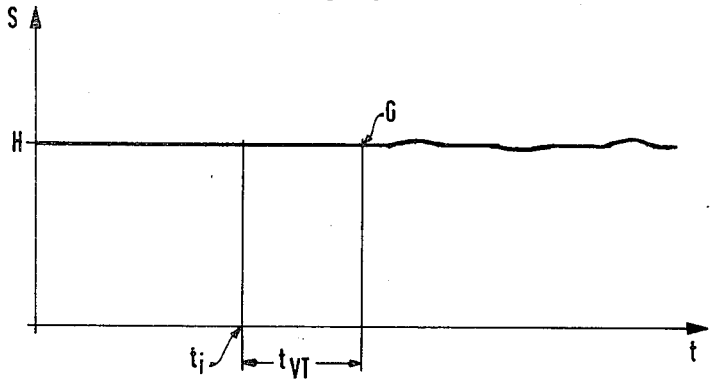
FIG. 4 is a diagram similar to FIGS. 2 and 3 for the transition from partial load to idling.

FIG. 4 represents a transition from partial load to idling. The central control circuit 1 in such case displaces the stop 10 in such a way that for a predetermined interval $t_{vl}$ (for example, likewise 2 seconds), the stop will stick in the position it had in the partial load mode of operation, namely the last position the stop had in the last previous idling operation of the engine, again corresponding to the PI sum in the intermediate store. Thereafter, idling speed regulation is allowed to come into effect.

In the transition from idling to drive, two different conditions can be recognized, thus (a) the throttle mechanism does not rest against the stop 10. In this case, the drive mode will be recognized in the engine speed is sufficient, which means that the displaceable stop backs off to its most withdrawn position.

(b) if the throttle mechanism lies against its stop, the idling mode will thenceforth be recognized;, in other words, the control circuit will regulate the position of the stop with reference to the idling speed reference value. In this manner, a malfunction of regulation can be prevented if the PI sum in the intermediate store has too great a value (in the transition from drive to idling, use of that value would push the stop too far out).

It has already been noted above that the controlling of the valves of the electro pneumatic positioning device is produced electrically in a manner by which an intermittent behavior of the valves is provided. At first it should be mentioned that, as will be further explained below, the central control circuit also receives a position signal relating to the situation of the displaceable stop and also information regarding the position of the throttle identifying the idling speed control mode. The signal regarding the position of the displaceable stop is an actual value signal and is compared in a suitable comparator of the control circuit with the reference value that is provided in the form of the PI sum in the intermediate store at the output of the controller amplifier.

Figure 5:
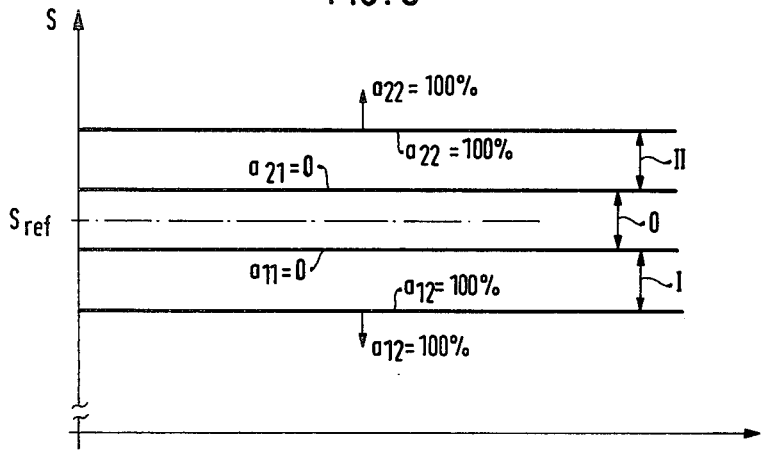
FIG. 5 is a diagram illustrating the application of regulation by means of pulses that are length-modulated.

FIG. 5 is a diagram illustrating how the control circuit 1 produces control of the positioning device 2 by a method resembling pulse length modulation in order to produce the desired positioning of the displaceable stop 10. In the region designated 0 of FIG. 5, which extends symetrically about the position reference value $S_{ref}$, indicated as a dot-dash horizontal line, no control force is exerted on the positioning member and both valves are closed. In other words, the displaceable stop 10 maintains its previous actual position, so that here there is a certain symetrical dead zone.

The region designated II in FIG. 5, where the actual value of displaceable stop position is too great, the evacuation valve 2*a* is operated with a keying ratio of $a_2$, which gradually rises with increasing distance from the reference value, from $a_{2,1}=0$ to $a_{2,2}=100\%$. The same holds for the region I, in which the actual value of the displaceable stop position is too small and therefore a pulse length modulated operation of the air inlet value 2*b* takes place.

In a preferred construction the sensing of the position of the displaceable stop is performed either by feeding back a picked-off potentiometer potential which is modified by the movement of the stop from one position to another, or else, in case the comparison circuit is of the digital type, the position sensing can be performed with the aid of an analog to digital converter which can be arranged to respond to a potentiometer voltage corresponding to position by reference to a multiplicity of threshold values. In FIG. 7 the potentiometer is shown as 15 and the digital to analog converter 9 provides analog signals for direct comparison with it.

FIG. 6 shows what is meant more exactly by means of a diagram. Once per clock pulse interval or, in the case a microcomputer is used, once per elementary program cycle, it is determined with reference to one of two threshold values, an upper threshold A and a lower threshold B, in alternation, whether the potentiometer voltage lies above or below the threshold and the respective values 2*a* and 2*b* of the position device are then operated accordingly. The two thresholds, as shown in FIG. 6*a*, have a sawtooth or triangular wave superimposed on them, which is to say that they execute sawtooth oscillations in step with each other, so that a pulse timed to identify A or B results directly by comparison with the actual position value provided by the potentiometer. The pulses can be intgrated after demultiplexing to provide control pulses of different length for different actual positions corresponding to different amounts of deviation from the reference value.

In FIG. *6a* the dash-dot line C designates the reference value for the position of the displaceable stop 10 provided by the PI sum in the intermediate store of the controller stage. The two threshold waves produced by the pulse forming stage are significantly disposed symmetrically about the reference value C, so that if the actual position value of the stop is identical with the reference value C, no intersections of the sawtooth pulses of the threshold A and B occur with the actual position value so long as it remains at or near the reference value C.

In FIG. *6a* three different courses of the actual position value are illustrated, first an upper constant actual value D, then a lower constant actual value E and also an obliquely rising actual value F which gradually approaches the desired reference value C. For the case of equality of the actual value position and the reference value C, both valves *2a* and *2b* of the positioning device are closed. In that case no displacement of the stop 10 is produced.

If the actual position value is consistently too high, as shown by the long-dark line D in FIG. *6a,* there result intersections with the sawtooth of the upper threshold A. Control pulses thereby produced for the evacuation valve are shown in FIG. *6b,* which is drawn to the same time base as FIG. *6a.* These control pulses have a constant pulse duration which would not be the case if the line D did not represent a constant actual position value. FIGS. *6b* and *6c* show the results for two possible conditions, the former for repeated operation of the evacuation valve and the latter for repeated operation of the air inlet valve (corresponding to the short-dash line E of FIG. *6a*). FIG. *6d* shows another possible course of operation of the air inlet valve corresponding to the oblique dash-dot line F of FIG. *6a.*

When the course of actual position value corresponds to line D of FIG. *6a,* it is evident from FIG. *6b* that the air inlet valve is not operated at all, but remains continuously shut, while control pulses are supplied to the evacuation valve, which is put in its open position during each of the pulses. It is evident that by operation of the evacuation valve a withdrawal of the displaceable stop is produced, so that, as is not shown in FIG. *6a,* the actual position value will begin to fall from the value represented by the line D. It is also evident that a gradual downward shift of the actual value line will shorten the duration of the control pulses and that the coverage intervals with the sawtooth theshold A will be come shorter.

If one assumes an actual value course corresponding to line E (short-dash line), the actual position value is too low and the displaceable stop 10 must be advanced more strongly. Since the actual value E deviates more greatly from the prescribed reference position value than did the previously assumed actual position value D, the intervals of coverage by the lower sawtooth threshold B will be greater and as shown in FIG. *6c* the result will be longer control pulses for the air inlet valve, while the evacuation valve is not operated at all and therefore remains shut.

The gradually rising actual value case shown in FIG. *6d* corresponds to the dot-dash line F of FIG. *6a;* it is evident that the value F gradually approaches the desired reference value C and accordingly in this case the control pulses for the air inlet valve consistently becomes smaller.

For temperature determination, the same digital-analog converter 9 can also be utilized. In the circuit 1, a counter 34 (FIG. 8) is advanced with every clock pulse of the oscillator or other timer of the control circuit 1, or with every program cycle of a microcomputer. This count condition is given to the digital-analog converter. As already mentioned, the multiple use of the converter 9 requires multiplexing for, thresholds A and B of FIG. *6a* and that can also provide a time slot for the temperature measurement. A comparator 11 is provided (see FIG. 7) to one input of which an analog temperature signal is provided by a suitable resistance network containing at least one NTC or PTC resistance, which is in heat conducting contact with an appropriate portion of the vehicle engine, for example in the cooling water. Since the comparator 11 continually receives a voltage at its other input proportional to voltage, i.e., a rising voltage from the digital-analog converter, the comparator 7 will then provide an output signal when the count proportional voltage of the central control circuit 1 exceeds the temperature dependent voltage. At this moment the last count state corresponds to the temperature value at the comparator, so that it is a measure for the temperature region in which the engine is working. This count state is transferred to a store when the comparator output signal appears, and is then utilized for temperature evaluation. At the same time the counter can be reset so that it can then be used again to detect temperature changes.

With regard to the displacement of the stop 10, two variants are possible. As already mentioned, at speeds in the "drive" range the stop 10 is retracted. This can happen either (a) because the evacuation valve *2a* is continuously open, which however has the effect that because of the considerable underpressure in the positioning device, a delay in the response of the positioning device when the engine goes out of the drive mode of operation will be produced, so that the vacuum that is present must first be diminished before any displacement at all will be possible, or else, in order to overcome this disadvantage, (b) the displaceable stop is merely brought back to a retracted position which lies in front of a fixed stop, at which time the evacuation valve is opened only long enough for the displaceable stop to reach this retracted position. The evacuation valve is then closed again, so that switchover into the regulation mode can be performed with the very shortest recovery times. The resulting loss in positioning path is very small.

Still another variant is possible for the operation in the partial load mode or in the transition from partial load to idling. The positioning device can, in accordance with this variant of the invention, be advanced to follow the throttle mechanism until it lies against the latter by appropriate setting of the integrator in the controller stage. This means that in the case of this variant, the integrator is not held at its previous value when the throttle is actuated by the accelerator pedal in the partial load operation. If then a transition from partial load into idling takes place, the positioning device is gradually retracted by regulation until it reaches the reference idling speed. The advantage is thus obtained that engine speed drop-off in transition from partial load to idling is avoided if just before during partial load operation the torque load of the motor should be raised, for example by switching in of energy consumers such as an air conditioner or the like. This variant is also advantageous for motor vehicles equipped with automatic transmissions.

A further possible variant for behavior in transition from drive into idling involves the provision of a differential component in the controller by which the integrator of the controller is set or incremented, after which regulation is started. The differential component is obtained by differentiating the speed signal, so that a larger differential component results if the deceleration is also large. There is accordingly obtained by means of the integrator a displacement of the stop 10 proportional to deceleration rate. The advantage arises from the fact that with greater speed diminution rate resulting from heavy torque load, a stronger displacement of the positioning device and thereby a better correction of the speed is obtained. This also is useful for motor vehicles having automatic transmissions, since the load torque of the torque converter depends strongly on previous events.

Finally, the possibility of a variant is to be noted for the partial load mode of engine operation and the transition from partial load to idling, by which the displaceable stop 10 remains under control with respect to engine speed in the partial load mode, while the reference idling speed can be modified and caused to follow the actual engine speed. Then, upon transition into the idling mode, the thus augmented reference idling speed can be caused to diminish according to a prescribed time function down to the original and normally desired reference speed for the idling operation, so that the engine speed will then be regulated down thereto in accordance with the prescribed time function.

FIG. 8 shows one form of implementation of the control circuit 1 of the system of FIG. 7 which has been described so far with only general indications of the contents of this control circuit.

The embodiment of FIG. 8 is based on the premise of a predominantly digital scheme of operation. Those circuit components that also appear in FIG. 7 are given the same reference numerals in FIG. 8.

FIG. 8 shows a clock pulse generator 20, a counter 21 for engine speed measurement by means of counting pulses from the pulse generator 20 and reset pulses from the monostable or bistable circuit 7 responsive to engine spark pulses, and a transfer gate 23 likewise responsive to the output of the circuit 7 (which is preferably constituted as a buffer store, where during engine operation there is always a count value present corresponding to a revolution period of the actual engine speed).

It is now possible either to convert the content of the buffer store 23 by a digital-analog converter into a voltage for further processing or to continue processing on a digital basis. In the case or analog treatment, the voltage can be compared with a constant voltage to provide a difference or to make the comparison by a reference voltage value influenced by other boundary conditions, and then to process further the error (difference) signal thus obtained by a controller-amplifier deriving PI components according to a version of the scheme of FIGS. 1*a* and 1*b* already discussed, and adding them to provide a reference position value for control of the positioning device 2 by a second error signal.

If the operation of the circuit 1 continues further on a digital basis, however, the count content stored in the buffer store 23 is compared with a reference count value stored in a register not specifically shown in FIG. 8, in which the reference speed value is put in. This comparison can take place by counting out repeatedly the content of the store 23 and of the register, or by counting out at a high rate a transfer counter (not shown) connected to the buffer store or the register, so that, in any of these cases, a count difference is produced, which may be referred to as the first error signal, which is then separately processed further to derive proportional and integral controller output components by supplying the first error signal to corresponding digital circuit components serving as function generators and incorporating the functions by which the characteristics illustrated in FIGS. 1*a* and 1*b* may be produced.

In the illustration given in FIG. 8, the obtaining of the first error signal by comparison with a reference speed value is represented in a general way by the block 24. The two following blocks 25 and 26 serve respectively for the separate derivation from the first error signal of a proportional output in the block 25 and an integral output in the block 26, both in the form of binary coded words. These two components are supplied in parallel to an intermediate store 27 and an output store 28, in the latter of which there is provided an output produced by adding the proportional and integral components, so that this is the PI sum representing the reference position value for the positioning device 2 and the displaceable stop 10.

Figure 6A:
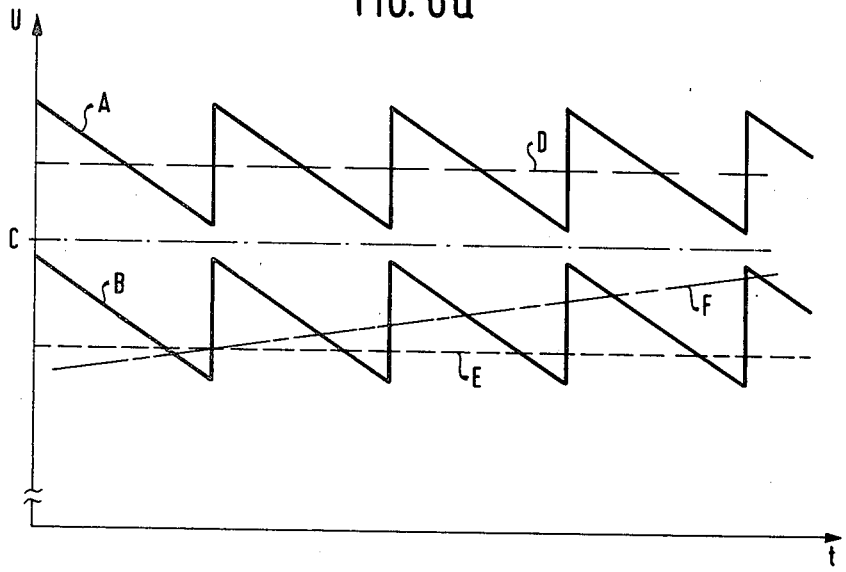
Figure 6B:
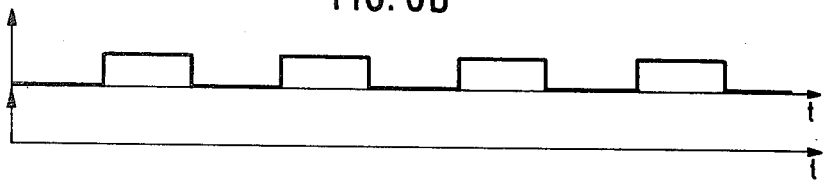
Figure 6C:
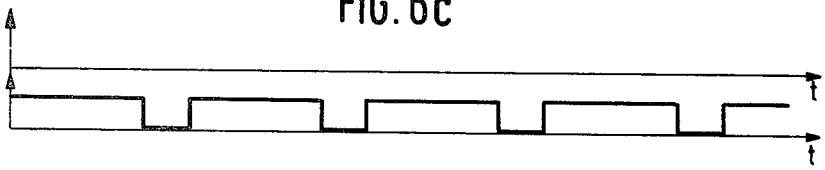
Figure 6D:
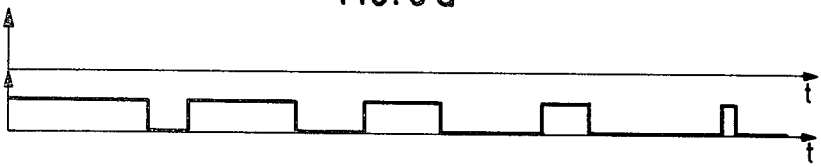

For comparison with the oscillating threshold value A and B illustrated in FIG. 6*a*, first the actual position value of the stop 10 is produced as a voltage by the potentiometer 15 (FIG. 7) and supplied to a comparator 12 (FIG. 7). FIG. 8 shows an illustrative way of providing the other input to the comparator 12 of FIG. 7, consisting of operating a first counter 29 and a second counter 30 at a high counting rate paced by the clock pulse generator 20 to provide the triangular wave variations. Although the count value provided by the output store 28 of the controller 25–28 is supplied to both the counters 29 and 30, the contents of the latter are caused to be different because the output store 28 feeds the two counters through different setting registers 31 and 32, each containing initial or offset values that result in the provision of outputs to the counter 29 and 30 which are different and symmetrically disposed about the PI sum itself that is provided at the output of the store 28. The counters 29 and 30 are each reset upon reaching a prescribed count value, by circuits not shown in the drawing for simplification of the illustration. The respective offset PI sum values in the registers 31 and 32 are added reset values to the counters 29 and 30, at the outputs of which there are accordingly rapidly changing count values. These are then supplied to a time-multiplex device from which the already described digital-analog converter 9 is supplied with the signals for the second input of the comparator 12 of FIG. 7. If desired, separate digital-analog converters can be used for the respective outputs of the counters 29 and 30. The signal provided to the comparator 12 then can be an analog sawtooth wave for producing (after demultiplexing the elementary pulses) the width modulated control pulses already described with references to FIG. 7.

The output signal of the digital-analog converter 9 thus provides the sawtooth-like threshold voltages A and B with which the actual position value signal for the displaceable stop 10, effectively represented by the potentiometer 15, is compared in the comparator 12 (FIG. 7). It will be recognized with reference to FIGS.

6*b* and 6*d* that pulses appear, after demultiplexing of the output of the comparator 12, that are modulated in length and that this demultiplexed output appears at one or the other of the demultiplexer outputs which are respectively connected to the stages 4*a* and 4*b*, so that the proper one of the valves is operated in accordance with the sign of the correction needed. The demultiplexer (not shown) must of course be synchronized in step with the multiplexer 33.

Still another counter 34 is provided for processing the temperature signal. The output signal of the comparator 11 is supplied to the control circuit 1 where it triggers a buffer store which is not shown in FIG. 8 and has the function of then storing the momentary temperature counter 34. The buffer store then contains a temperature signal which can then be used, for example, to produce reference value changes. Thus by means of this temperature signal, which in the system illustrated in FIG. 8 is provided as a binary code word, the idling speed reference value stored in a register above mentioned but not shown in FIG. 8 can be modified in accordance with a function selected for being suitable to the particular engine type, so that the engine can be operated at a higher reference idling speed when it is cold.

FIG. 8 also shows still another counter 35 for processing the signal of the throttle switch 35*c* indicating whether or not the throttle mechanism is lying against a stop (usually the stop 10). The switch signal is provided to the inputs 35*a* and 35*b*, one of which serves for advancing the counter when the signal is logic 1 and the other of which serves for counting it down when the signal is logic 0. As soon as the counter 35, as already described before, reaches a prescribed maximum or minimum value, a buffer store 36 is set or reset. This buffer store can be a simple bistable circuit, and its output shows reliably (independently of switch contact bounce) whether the throttle is resting on a stop or has been lifted off it. The output signal of the bistable circuit 36 serving as a buffer store proceeds over the connection 37 to the controller amplifier which processes the first error signal to produce proportional and integral components. If the throttle switch signal is logic 1, thus an accelerator actuation signal, then, as already mentioned, the output signal of the integrator in the block 26 is held constant, and the proportional controller amplifier for the first error signal, contained in the block 25, is blocked (disabled).

It should now be evident that the various sequences of operation described above in connection with FIGS. 2–6 can all be carried out with the circuit shown in FIG. 8. It is principally the output signal of the buffer store (flipflop) 36 that here provides for the "throttle-on-stop" signal. Regarding the processing of the effective actual speed value signal in the buffer store 23, still other comparison stores are provided, as already mentioned, not shown in FIG. 8 and making it possible for fulfilling the already described functions relating to the various engine operating modes and transition operations.

Thus from the output of a first comparison store, when the actual speed value in the store 23 is a speed in the starting range, the air inlet valve 2*b* in the positioning device 2 is directly operated, whereby the stop 10 is moved out all the way. If drive mode intervals occur, then another comparison store in which the lower limit speed for drive mode is set as a reference value, so that here again after transition from the speed regulated operation, the positioning member 2 is retracted, for example by immediate operation of the evacuation valve 2*a*. It will be readily recognized that in this manner, operation in all the modes and through all the transition periods can be carried out as already described. One more thing only remains to be mentioned, by way of example regarding the transition from the drive into the idling mode. When a signal signifying that the throttle mechanism lies against its stop is produced by switching over of the flipflop 36, the output signal of the latter produces a switching over of the inputs of the counters 29 and 30 and hence of the setting registers 31 and 32 over to the intermediate store 27 (as symbolized by the broken line 40) in order to take over for their operation the PI sum there stored as the reference value for controlling the positioning device 2. At the same time a counter (not shown in FIG. 8) can be cut in which determines the delay time $t_{vs}$ by the time required for it to reach its maximum value, after which the inputs of the registers 31 and 32 are switched back from the intermediate store 27 to the output store 28, simultaneously with setting the engine speed regulation into operation. If it is desired to produce the brief cylinder filling increase for avoidance of engine speed faltering, then for a short transition interval, different increased initial values can be put into the offset registers 31 and 32. Since these circuit operations are regarded as conventional for persons skilled in the art, further details regarding their accomplishment need not be mentioned here.

For completeness, it should further be mentioned that the displacement of the working end of the positioning device 2 and hence of the displaceable stop 10 is designated S in the graphical representations given in FIGS. 2, 3 and 4, while at the points G of the curves of FIGS. 2 and 4, the putting into effect of the speed regulation takes place. In FIG. 2, H designates the last previous speed value in the idling mode, while the moment $T_0$ designates the beginning of the transition from drive into idling. Similarly, in the FIG. 4 diagram, the transition from partial load into idling takes place at $T_1$ and occupies the there illustrated time interval $t_{VT}$.

Although the invention has been described with reference to particular illustrated embodiments, it will be recognized that modifications and variations are possible within the inventive concept.

Finally, it should also be noted that a preferred method and a preferred modification of the control circuits for practicing and implementing this invention was invented jointly by us and Adolf Freitag and is disclosed in a copending application owned by the Assignees of this invention, claiming the same priority date under 35 U.S.C. Section 119 and further identified as Ser. No. 436,399, filed 10/25/82, entitled "Idling Speed Control for Internal Combustion Engines, the disclosure of which is hereby incorporated by reference.

We claim:

1. Method of controlling the idling speed of a motor vehicle's internal combustion engine having a speed-controlling throttle in an air-and-fuel intake suction duct and an accelerator control actuatable by a vehicle driver, said method being automatically operable by means of a displaceable stop for continually adjusting an idling setting of said throttle during particular conditions of operation of said engine, said method comprising the steps of:

measuring the actual value of engine speed;

comparing said actual engine speed value with a previously established reference idling speed value and thereby producing a first error signal;

converting said first error signal into a reference position value for said displaceable stop by processing said error signal in a proportional-integral (PI) controller in which proportional and integral components are derived from said first error signal which are quantized so as to vary stepwise as the engine speed goes from one speed range to another, both said components having null value for a dead zone speed range on each side of said reference speed value and both said components having constant values over the range of each speed range step, said quantized proportional and integral components being added together in said controller;

ascertaining continuously the actual position of said displaceable stop;

comparing the actual position of, and said reference position value for, said displaceable stop and thereby producing a second error signal, and displacing said stop by and in accordance with said second error signal.

2. Method according to claim 1 in which the step of converting said first error signal into a reference position value for said displaceable stop includes amplification of said proportional and integral components derived from said error signal before the addition of said components together in such a manner that the stepwise changes in magnitude of said components with increasing deviation of actual engine speed from said reference idling speed value are asymetric about said reference idling speed value, according to whether the deviation is below or above said reference idling speed value.

3. Method according to claim 2, in which, so long as said engine is operating in one of the modes known as start up, partial load or drive, the displacement of said stop is determined independently of engine speed.

4. Method as defined in claim 2 in which there is performed the step of continuously storing said first error signal in an intermediate store.

5. Method according to claim 4 in which the result of adding together said proportional and integral components derived from said first error signal is averaged in said intermediate store over a certain time and the average value so produced is made available in an output store thereof.

6. Method according to claim 5 in which the step is performed of producing an accelerator actuation signal when said accelerator control is actuated in a manner moving or keeping it away from said displaceable stop, the initiation of said accelerator actuation signal being an indication of transition of the operating mode of said engine into the partial load mode, and being used to halt the further averaging of the content of said intermediate store and the provision by said output store of the last-formed average value as the reference position value for said displaceable stop for producing a second error signal for control of displacement of said stop during said partial load mode operation of said engine.

7. Method according to claim 6 in which the step is performed of comparing engine speed with a predetermined minimum value of engine speed for the "drive" mode of operation of the engine and that the indication of an engine speed greater than said minimum "drive" engine speed is used for recognition of the "drive" mode of operation of said engine and in response to such recognition said displaceable stop is caused to be moved back in the direction of lower idling speed, against a permanent stop.

8. Method according to claim 7 in which during the start up mode of operation of said engine, as recognized by said engine being in its lowest speed range of operation, said displaceable stop is put in its end position in the direction toward higher idling speed, the engine temperature is measured and initial values are provided for the integrator content of said intermediate store and for the sum of said proportional and integral components derived from said error signal, respectively in said output store and in said intermediate store.

9. Method according to claim 8 in which the step of measuring the actual value of engine speed is performed by counting pulses produced at a fixed rate during the interval between successive pulses produced by said engine synchronously with revolution of a shaft thereof, then storing the count so obtained and resetting the counter at the end of each counting interval.

10. Method according to claim 9 in which the counting pulses within the counting intervals are obtained from the program cycle timing pulses of a microprocessor running at a constant cycle period, for incrementing a counter with the completion of every cycle.

11. Method according to claim 10 in which for avoiding interference from contact bounce of a switch used to provide said accelerator actuation signal, the counter utilized for measuring engine speed is caused to count up or down according to the presence or absence of said accelerator actuation signal, and when the maximum or minimum count value is reached an additional intermediate store is reset or set.

12. Method according to claim 11 in which in response to a transition from "drive" mode of operation into idling mode of operation of said engine the sum of said proportional and integral components derived from said first error signal existing in said intermediate store at the time of transition is utilized to produce said second error signal for a predetermined interval of time ($t_{vs}$) following said transition, whereby said displaceable stop is caused to remain in its position at the time of said transition until the beginning of regulation with reference to engine speed at the end of said time interval.

13. Method according to claim 12 in which in order to avoid sudden changes of engine speed, for a short time interval within said previously mentioned time interval ($t_{vs}$), a constant value is added to said second error signal.

14. Method according to claim 13 in which in a transition from the "drive" mode to the partial load mode of operation of said engine, the blocking of regulation responsive to engine speed is maintained for a transition time interval ($t_{vs}$) and thereafter said displaceable stop is maintained in the last idling range position thereof.

15. Method according to claim 6 in which in the partial load mode of operation of said engine, said displaceable stop is displaced responsive to engine speed with simultaneous following up of said reference idling speed value in relation to said actual speed value and that upon a following transition to the idling mode of operation said raised reference idling speed value is reduced to the normal reference idling speed value in accordance with a predetermined time function.

16. Method according to claim 8 in which engine temperature is digitally measured by: incrementing a counter at a fixed rate, converting the count condition of said counter to an analog signal, comparing said analog signal with a voltage perportional to engine temperature produced by an electrical thermometer and providing a digital temperature signal in response to the output of the comparison.

17. Method according to claim 11 in which upon transition from the partial load mode to the idling mode of operation of said engine, said displaceable stop is maintained for a predetermined time interval ($t_{vt}$) and the last partial load position corresponding to the last reference value position for said displaceable stop produced by converting said error signal before transition, after which regulation responsive to engine speed goes into effect.

18. Method according to claim 11 in which in a transition from the idling to the drive mode of operation of said engine the presence of said acceleration actuation signal is required and in the absence thereof the mode of operation of said engine is recognized as again being the idling mode.

19. Method according to claim 12 in which upon a transition from the drive to the idling condition of said engine an integrator used for deriving said integral component from said first error signal is set by means of a differential component derived from said first error signal and regulation of said idling speed is allowed to proceed thereafter by provision through said integrator of a displacement of said displaceable stop proportional to a deceleration rate.

20. Method of controlling the idling speed of a motor vehicle's internal combustion engine having a speed-controlling throttle in an air-and-fuel intake suction duct and an accelerator control actuatable by a vehicle driver, said method being automatically operable by means of a displaceable stop for continually adjusting an idling setting of said throttle during particular conditions of operation of said engine, said method comprising the steps of:

measuring the actual value of engine speed;

comparing said actual engine speed value with a previously established reference idling speed value and thereby producing a first error signal;

converting said first error signal into a reference position value for said displaceable stop by processing said error signal in a proportional-integral (PI) controller in which the respectively proportional and integral components are derived from said first error signal and are added together;

ascertaining continuously the actual position of said displaceable stop;

comparing the actual position of, and said reference position value for, said displaceable stop and thereby producing a second error signal, and displacing said stop electropneumatically by and in accordance with said second error signal, by means of air admission and evacuation valves, each valve being pulsed by electric pulse control operating in the manner of pulse length modulation, the keying ratio of the control pulses increasing with the magnitude of said second error signal, said evacuating valve being continuously held open during the "drive" mode of operation of said engine, for full retraction of said displaceable stop.

21. Method of controlling the idling speed of a motor vehicle's internal combustion engine having a speed-controlling throttle in an air-and-fuel intake suction duct and an accelerator control actuatable by a vehicle driver, said method being automatically operable by means of a displaceable stop for continually adjusting an idling setting of said throttle during particular conditions of operation of said engine, said method comprising the steps of:

measuring the actual value of engine speed;

comparing said actual engine speed value with a previously established reference idling speed value and thereby producing a first error signal;

converting said first error signal into a reference position value for said displaceable stop by processing said error signal in a proportional-integral (PI) controller in which the respectively proportional and integral components derived from said first error signal are added together;

ascertaining continuously the actual position of said displaceable stop;

comparing the actual position of, and said reference position value for, said displaceable stop and thereby producing a second error signal;

displacing said stop electropneumatically by and in accordance with said second error signal by means of air admission and evacuation valves, each valve being pulsed by electric pulse control operating in the manner of pulse length modulation, the keying ratio of the control pulses increasing with the magnitude of said second error signal;

providing the electric pulse control of said valves by generating a comparison threshold voltage of sawtooth or triangular form and causing it to shift, up and down, the said reference position value for said displaceable stop derived from said first error signal, after which the result is compared with the actual position value of said displaceable stop, as furnished by a displacement-to-voltage converter, in order to produce said pulses as a comparison output, and holding said displaceable stop in position against a permanent stop by intermittently controlling said evacuation valve in such a way as to provide short recovering times for the onset of control of said displaceable stop when the "drive" mode of operation of said engine terminates.

22. Method according to claim 21 in which upon the engine entering into the partial load mode of operation, said displaceable stop is caused to follow said throttle valve, without further opening it, by setting an integrator used for deriving said integral component of said first error signal, in such a way that upon a following transition from partial load into idling mode of operation of said engine, a regulated setting back of the position of said displaceable stop takes place towards said reference idling speed value.

23. Apparatus for controlling the idling speed of a vehicular internal combustion engine having a speed-controlling throttle in an air-and-fuel intake suction duct, a throttle control mechanism and an accelerator control actuatable by a vehicle driver for operating said throttle control mechanism, said apparatus including a stop for continually adjusting an idling setting of said throttle, for limiting the low-speed end of the control range of said throttle control mechanism, said stop being displaceable at least during idling operation of said engine, and also further comprising:

means for measuring engine speed, comparing measured engine speed with a reference value of idling speed and thereby producing a first error signal;

means for providing a predetermined normal idling speed value as a reference value for comparison with measured idling speed;

means for measuring the position of said displaceable stop within its range of displacement;

PI controller means for deriving proportional (P) and integrated (I) signal components from said first error signal and adding them together to provide a PI sum signal of a magnitude range suitable for use as a reference position value for comparison with the measured position of said stop, said controller means having an integrator for forming said I signal component and being constituted to provide P and I signal components which, outside of a speed range centered on said reference idling speed, are greater when measured engine speed is below said reference idling speed than when measured engine speed is above said reference idling speed;

means for comparing the measured position of said displaceable stop with said PI sum signal and producing therefrom a second error signal, and means for displacing said stop in a direction determined by the sign of said second error signal and at a rate substantially proportional to the absolute magnitude of said second error signal;

means for detecting the removal of said throttle control mechanism from said stop and thereby producing an accelerator actuation signal; and means responsive to said accelerator actuation signal for holding constant the I signal component in said integrator and for blocking the production of said P signal component in said controller means.

24. Apparatus according to claim 23, further comprising an engine temperature sensor and means for increasing said reference idling speed value while the engine is colder than a predetermined temperature.

25. Apparatus according to claim 23, in which said means for producing said first error signal and said PI controller means are constituted with digital electronic circuitry so that said PI sum signal is a binary coded digital signal and further comprising digital-analog converter means for converting said PI sum signal into analog form, said means for producing said second error signal including means for so modifying at least one of the signals compared for producing said second error signal that said second error signal is provided in the form of pulses modulated in pulse duration over at least a predetermined range of absolute magnitude of said second error signal.

26. Apparatus according to claim 25, in which said signal modifying means is constituted for modifying said PI sum signal by converting it into two signals offset in voltage on opposite sides of the original signal value and superimposing thereon a substantially triangular wave and in which said means for producing said error signal includes a multiplexing means for alternately comparing said two offset signals as modified by said wave with an actual position value signal for said displaceable stop and for distributing said second error signal in oppositely acting manner to said stop-displacing means according to which of said two offset signals is used to provide said second error signal.

27. Apparatus according to claim 26, in which said stop-displacing means is of the electropneumatic type including an evacuation valve and an air inlet valve, respectively for opposite displacement directions, said valves being magnetically operated.

* * * * *